United States Patent [19]

Swales, deceased et al.

[11] 4,408,536

[45] Oct. 11, 1983

[54] METHOD OF RE-ENTRY BODY SEPARATION AND EJECTION

[75] Inventors: Frank Swales, deceased, late of Saratoga, Calif.; Doris Swales, heir, Santa Clara, Calif.

[73] Assignee: The United States of America as represented by the Secretary of the Navy, Washington, D.C.

[21] Appl. No.: 819,447

[22] Filed: Jun. 30, 1977

[51] Int. Cl.[3] ..... F42B 15/00

[52] U.S. Cl. ..... 102/379; 244/3.23

[58] Field of Search ..... 102/49.4, 49.5, 378, 102/379; 244/3.23

[56] References Cited

U.S. PATENT DOCUMENTS

| | | | |
|---|---|---|---|
| 3,067,682 | 12/1962 | Feldmann et al. | 102/350 X |
| 3,368,486 | 2/1968 | Webb | 102/378 |
| 3,534,686 | 10/1970 | Watson et al. | 102/378 |
| 3,754,725 | 8/1973 | Kartzmark | 244/3.23 |
| 4,002,120 | 1/1977 | Swaks | 102/378 |

*Primary Examiner*—David H. Brown

*Attorney, Agent, or Firm*—R. S. Sciascia; Charles D. B. Curry; Francis I. Gray

[57] ABSTRACT

A method of separating and ejecting a re-entry body from a booster rocket without tip-off by igniting a pair of diametrically opposed rockets attached to the base of the re-entry body which provide thrust at an angle, and then firing a plurality of pyrotechnically operated separation nut assemblies, with the attachment bolts being captured in bolt catcher assemblies, to separate the re-entry body from the booster rocket, the pair of rockets providing separation velocity and spin to the re-entry body.

2 Claims, 3 Drawing Figures

METHOD OF RE-ENTRY BODY SEPARATION AND EJECTION

BACKGROUND OF THE INVENTION

1. Field of the Invention

The present invention relates to separation methods, and more particularly to a method of separating and ejecting a re-entry body from a missile.

2. Description of the Prior Art

In many previous separating mechanisms explosive energy has been used for simultaneously disconnecting and moving one section of a multistage rocket or missile relative to another section. The connecting structures between sections have been designed so that the rapidly expanding gases from the explosion which severs the two sections acts in a direction to also separate them, such as by driving a piston. Explosive devices can leave sharp, irregular edges which create a turbulent flow condition around a re-entry body which affects its speed and motion, and also can produce an undesirable tumbling motion, "tip-off", due to the unpredictability of the effects of the rapidly expanding gases, rather than a smooth, straight line motion.

Numerous mechanical devices have been used to provide the thrust to separate two sections, such as compression springs, spinning weights, and even magnets. And application of reverse thrust by the discarded section has also been used.

However, for a re-entry body it is also desirable to provide spin stabilization so that the re-entry body maintains its ballistic trajectory during the turbulence associated with re-entry into the earth's atmosphere. Mechanical devices operating at an angle, such as compression springs, have been used to impart both separation thrust and spin. But the usual technique is to spin stabilize the last stage before separation by the use of spin rockets attached circumferentially to the last stage with a thrust force tangential to the radius of the stage.

SUMMARY OF THE INVENTION

Accordingly, the present invention provides a pair of diametrically opposed rockets mounted on the base of a re-entry body to provide thrust at an angle in conjunction with a plurality of pyrotechnic separation nut and bolt catcher assemblies. The firing of the separation nut assemblies and the capturing of the attachment bolts in the bolt catcher assemblies provide the separation of the re-entry body from a booster rocket without tip-off, and the angular thrust of the pair of rockets provides both separation velocity and spin to the re-entry body. The rockets are ignited just prior to separation so that full thrust is developed at separation.

OBJECTS OF THE INVENTION

Therefore, it is an object of this invention to provide a method of separating and ejecting a re-entry body from a booster rocket.

Another object of this invention is to provide separation velocity and spin to a re-entry body from a single source of thrust.

A further object of this invention is to provide separation of a re-entry body from a rocket booster without tip-off.

Other objects, advantages and novel features of the invention will become apparent from the following detailed description of the invention when considered in conjunction with the accompanying drawings wherein:

DESCRIPTION OF THE PREFERRED EMBODIMENT

Figure 1:
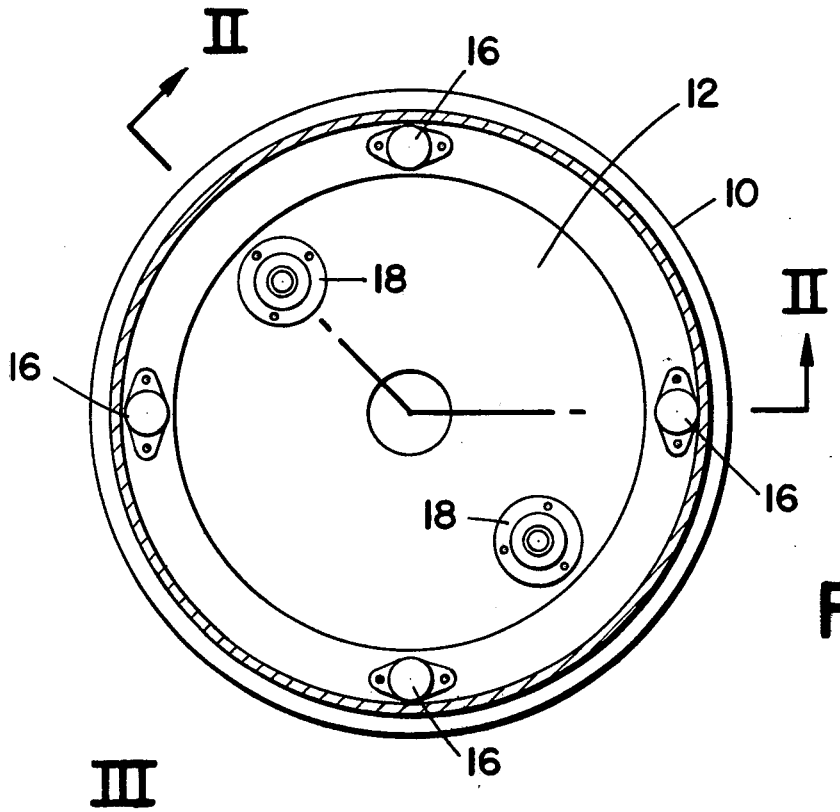
FIG. 1 is a cross-sectional view of a re-entry body facing toward a rocket booster.
Figure 2:
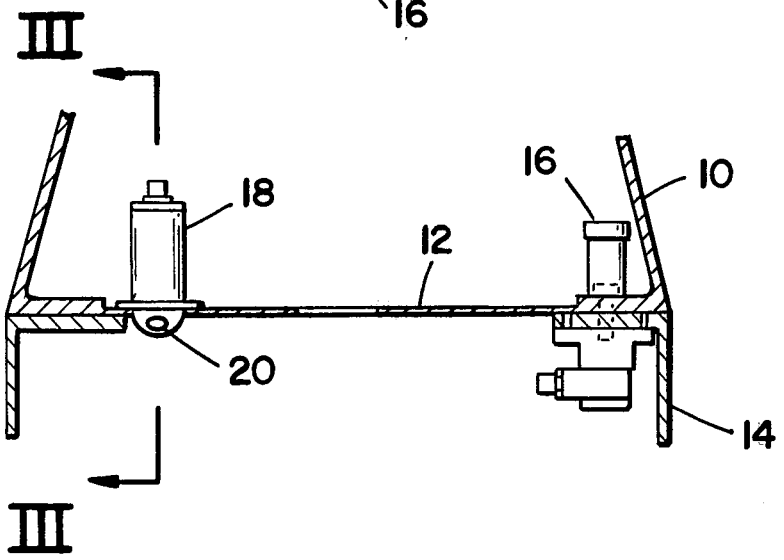
FIG. 2 shows a section of the re-entry body taken on the line II—II of FIG. 2.
Figure 3:
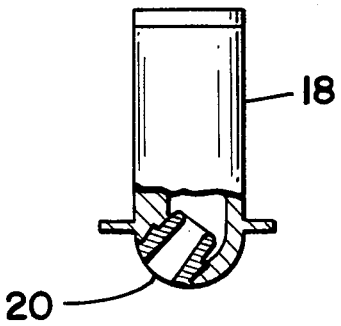
FIG. 3 shows a partial section of one of the rockets taken on the line III—III of FIG. 3.

Referring now to FIGS. 1–3, a re-entry body 10 is shown looking down to a base plate 12. The re-entry body 10 is attached to a booster rocket 14 by a plurality of separation nut and bolt catcher assemblies 16 (See U.S. Pat. No. 4,002,120 filed July 31, 1975). A pair of diametrically opposed rockets 18, each having a nozzle 20, are mounted on the base plate 12 so that the nozzles project to the rear external of the re-entry body 10 at an angle. The angle of each nozzle to the axis of the re-entry body 10 is such as to provide a component of thrust parallel to the axis of the re-entry body and a component of thrust tangential to the radius of the re-entry body. The pair of rockets 18 are mounted such that the tangential components of the thrust from each rocket aid each other.

In operation the rockets 18 are ignited a few milliseconds before firing the separation nut and bolt catcher assemblies 16 in order for the rockets to develop maximum thrust before separation takes place. Then the separation nut assemblies 16 are fired simultaneously, ejecting the attachment bolts to positions within the respective bolt catchers, as described in U.S. Pat. No. 4,002,120, and resulting in separation of the re-entry body 10 from the booster rocket 14 without tip-off.

Once separation has occurred the rocket motors 18, operating at maximum thrust, are free to accelerate the re-entry body 10 away from the booster rocket 14 and to spin stabilize the re-entry body.

Thus, the present invention results in a clean separation of a re-entry body from a rocket booster without tip-off while providing separation velocity and spin stabilization from a single source.

I claim:

1. A method of re-entry body separation and ejection from a rocket booster, the rocket booster and the re-entry body being held together by a plurality of separation nut and bolt catcher assemblies, comprising the steps of:

(a) igniting a pair of rockets arranged at two diametrically opposite positions on the base of said re-entry body to provide a thrust vector at an angle such that one component of said thrust vector provides the necessary separation velocity between said re-entry body and said rocket booster upon separation, and a second component of said thrust vector provides the spin-up of said re-entry body about the re-entry body axis upon separation;

(b) firing a plurality of separation nut assemblies simultaneously shortly after igniting said pair of rockets; and (c) ejecting a plurality of attachment bolts released by the firing of said plurality of separation nut assemblies to a position within a plurality of respective bolt catcher assemblies, whereby said re-entry body and said rocket booster are separated without tip-off, and said pair of rocket motors are free to accelerate said re-entry body away from said booster while spinning-up said re-entry body for ballistic stability.

2. A re-entry body separation and ejection system comprising:

(a) a plurality of separation nut and bolt catcher assemblies, each having a pyrotechnic separation nut, a bolt catcher and an attachment bolt which is ejected into said bolt catcher upon the firing of said pyrotechnic separation nut assembly, said plurality of separation nut and bolt catcher assemblies arranged to hold said re-entry body to a rocket booster and to separate said re-entry body from said booster without tip-off when said pyrotechnic separation nuts are fired; and (b) a pair of diametrically opposed rocket motors located on the base of said re-entry body, said rocket motors arranged to provide thrust at an angle, said thrust providing the necessary separation velocity between said re-entry body and said rocket booster upon separation and providing spin to said re-entry body upon separation, said rocket motors being ignited just prior to the firing of said separation nut assemblies.

* * * * *